US006157129A

United States Patent [19]

Rausenberger et al.

[11] Patent Number: 6,157,129

[45] Date of Patent: Dec. 5, 2000

[54] DISCHARGE LAMP

[75] Inventors: Bernd Rausenberger, Aachen; Dieter Leers, Stolberg; Horst Dannert, Aachen; Klaus Löhn, Simmerath; Martin Ossmann, Aachen, all of Germany

[73] Assignee: U.S. Philips Corporation, New York, N.Y.

[21] Appl. No.: 09/165,684

[22] Filed: Oct. 2, 1998

[30] Foreign Application Priority Data

Oct. 7, 1997 [EP] European Pat. Off. ..... 97203089

[51] Int. Cl.[7] ..... H01J 17/04

[52] U.S. Cl. ..... 313/631; 315/248; 315/344; 313/491; 313/161

[58] Field of Search ..... 313/631, 161, 313/491, 493, 234, 607; 315/344, 248

[56] References Cited

U.S. PATENT DOCUMENTS 5,291,091 3/1994 Eggink et al. ..... 313/161
5,349,271 9/1994 Van Od et al. ..... 313/161 X
5,834,907 11/1998 Takehara ..... 315/307

*Primary Examiner*—Ashok Patel
*Attorney, Agent, or Firm*—F. Brice Faller

[57] ABSTRACT

The discharge lamp comprises a piezotransformer and at least one of the lamp electrodes comprises a secondary side of the piezotransformer. Since the piezotransformer functions as a lamp electrode, as a ballast choke and as a transformer, the discharge lamp can be operated by means of a relatively simple and cheap ballast circuit.

16 Claims, 3 Drawing Sheets

DISCHARGE LAMP

BACKGROUND OF THE INVENTION

The invention relates to a discharge lamp for generating electromagnetic radiation equipped with a gastight discharge vessel that contains a filling that comprises a gas. The vessel is transmissive for at least part of the electromagnetic radiation that is generated by the filling during operation, and is equipped with lamp electrodes between which a discharge is maintained during operation The invention also relates to a lighting arrangement comprising a discharge lamp and a ballast circuit.

An example of such a discharge lamp is a low pressure mercury discharge lamp, also called fluorescent lamp, as for instance described in "Electric discharge lamps" by J. F. Waymouth, M.I.T. Press, Cambridge 1971. In such a fluorescent lamp the filling comprises apart from a noble gas also mercury and the wall of the gastight discharge vessel is covered with a luminescent layer that during operation converts the UV-radiation generated in the lamp into visible radiation. The lamp electrodes are normally present in the discharge vessel and consist of a metal alloy covered with an emitter material. It has been found that such fluorescent lamps can be operated with high efficiency (1 m/W) by means of a high frequency current. Such a high frequency current is often generated out of a supply voltage supplied by a supply voltage source by means of ballast circuit comprising a DC-AC-converter. Because of the relatively high voltages that are needed to ignite the fluorescent lamp and maintain the discharge during stationary operation, the DC-AC-converter is often equipped with a transformer. In such a DC-AC-converter the lamp is coupled to the secondary side of the transformer. Such a transformer can be an inductive transformer or a piezotransformer. DC-AC-converters that are equipped with a piezotransformer offer substantial advantages. First of all, piezotransformers can be very flat and small so that the ballast circuit can also be flat and small, which is very important in case the ballast circuit is for instance used to operate a lamp that serves as a backlight in a flat panel display. Furthermore, since piezotransformers have a positive current-voltage relation a separate ballast choke can often be dispensed with. Another important advantage is that the properties of the piezotransformer are strongly dependent on load that is coupled to its secondary side. In practice it has been found that because of this strong dependency it is possible to generate an ignition voltage having a relatively high amplitude (e.g. 1–1.6 kV) and a much lower lamp voltage (e.g. approximately 500–800 Volt) that maintains the discharge during stationary operation by applying the same signal to the primary side of the piezotransformer. This means that the DC-AC-converter need not comprise additional circuitry for changing the signal present at the primary side of the piezotransformer upon ignition of the lamp and can therefore be relatively simple and cheap. Despite these advantages, a lighting arrangement that comprises such a known discharge lamp and a ballast circuit for operating the discharge lamp comprises many components.

SUMMARY OF THE INVENTION

The piezotransformer functions not only as an lamp electrode during operation of the discharge lamp but also as a transformer and as a ballast choke, so that in a ballast circuit that is used to operate the discharge lamp according to the invention a transformer and a ballast choke can both be dispensed with. As a result the ballast circuit for operating the lamp can be relatively compact and cheap and the same is true for a lighting arrangement comprising both a discharge lamp according to the invention as well as a ballast circuit for operating the lamp.

A discharge lamp according to the invention can be a discharge lamp for ordinary lighting applications generating visible light but can also generate UV light or IR light.

Good results have been obtained for discharge lamps according to the invention, wherein the gastight discharge vessel contains a filling that comprises a noble gas and is transmissive for visible light.

Good results have also been obtained for discharge lamps according to the invention, wherein the secondary side of the piezotransformer and the filling of the discharge vessel are in direct contact with each other. Alternatively, however, the emission of electrons from the secondary side of the piezotransformer can be enhanced by applying a sheet of conductive material that is present between the secondary side of the piezotransformer and the filling of the discharge vessel and covers at least part of the surface area of the secondary side that is inside of the discharge lamp.

Additionally it is also possible to enhance the emission of electrodes by means of a layer of emitter material that is present between the secondary side of the piezotransformer and the filling of the discharge vessel and covers at least part of the surface area of the secondary side that is inside of the discharge lamp.

In a relatively simple embodiment the piezotransformer comprises one primary side and two secondary sides and each of the secondary sides is comprised in a different lamp electrode of the discharge lamp. Since this relatively simple embodiment of a discharge lamp according to the invention comprises only one piezotransformer it can be relatively easily manufactured and is relatively cheap.

Alternatively, in embodiments wherein each lamp electrode of the discharge lamp comprises a piezotransformer and each of the piezotransformers comprises a separate primary side and a separate secondary side, the shape of the discharge vessel can be chosen independently from the lamp electrode construction.

In another relatively simple embodiment the discharge vessel forms a capacitive coupling between the discharge and mass potential during operation, said capacitive coupling functioning as a second lamp electrode. This relatively simple embodiment comprises only one piezotransformer that has only one secondary side. It can therefore be relatively easily manufactured and is relatively cheap.

Since some of the materials that are used to manufacture piezotransformers are transmissive for visible light, it is possible to manufacture the lamp vessel and the piezotransformer of a discharge lamp according to the invention out of the same material. Such a discharge lamp can be manufactured relatively easily.

Good results have been obtained for discharge lamps according to the invention in which the piezotransformer is of the Rosen type.

The invention is very suitable to be practised in discharge lamps of the type low pressure gas discharge lamp and more in particular in discharge lamps of the type low pressure mercury discharge lamp.

Preferably each part of the outer surface of the secondary side of a piezotransformer comprised in an electrode that is not in contact with a primary side is surrounded by the discharge vessel. A user of such a discharge lamp can not inadvertently touch the secondary side of a piezotransformer and thereby be exposed to relatively high voltages.

It is preferred to attach the discharge vessel to the piezotransformer at a place where during operation a node of the mechanical vibration of the piezotransformer is present. This minimizes the risk of damage to the attachment by the mechanical vibration. Generally the position of the nodes depends on the operating frequency.

DETAILED DESCRIPTION

Figure 1:
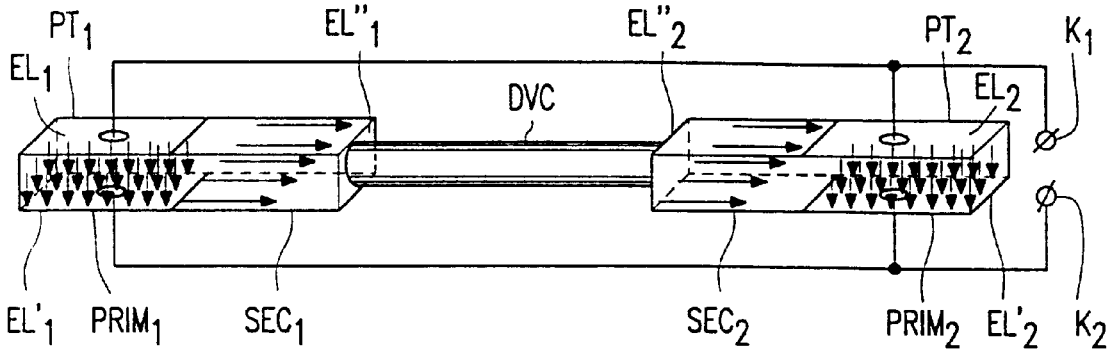
FIGS. 1–5 show embodiments of a discharge lamp according to the invention.

In FIG. 1, DCV is a cylindrical gastight discharge vessel formed out of glass and filled with Ar. A first end of the discharge vessel DCV is sealed in a vacuum tight manner to a secondary side SEC1 of a first piezotransformer PT1. A second end of the discharge vessel DCV is sealed in a vacuum tight manner to a secondary side SEC2 of a second piezotransformer PT2. PRIM1 and PRIM2 are primary sides of respectively piezotransformer PT1 and piezotransformer PT2. Both piezotransformers PT1 and PT2 are of the Rosen type and are shaped as square parallelepipeds. Two opposing surface areas of primary side PRIM1 are covered with electrodes E11 and E11'. In this embodiment the electrodes consist of a metallic layer. Likewise two opposing surface areas of primary side PRIM2 are covered with electrodes E12 and E12'. The primary sides PRIM1 and PRIM2 are polarized in the same direction perpendicular to the electrodes. The secondary sides SEC1 and SEC2 are both polarized in the same direction perpendicular to the direction of polarization of the primary sides and parallel to the axis of the discharge vessel DCV. The outer surfaces of the secondary sides SEC1 and SEC2 that are in contact with the discharge vessel DCV function as third electrodes E11" and E12" of respectively piezotransformer PT1 and piezotransformer PT2. Electrode E11 and electrode E12 are connected to input terminal K1 and electrode E11' and electrode E12" are connected to input terminal K2.

The discharge lamp shown in FIG. 1 operates as follows.

When input terminals K1 and K2 are connected to a source of an input voltage with a frequency that is close to one of the resonance frequencies of the piezotransformers PT1 and PT2, each of the piezotransformers transforms the input voltage to an output voltage with the same frequency but a much higher amplitude that is present between the third electrode and each of the other electrodes of the same piezotransformer. Since the two secondary sides are polarized in the same direction, the voltage over the discharge vessel that is present between the two third electrodes E11" and E12", equals the sum of the output voltages of the piezotransformers. If the discharge lamp was not yet ignited, it ignites under the influence of the voltage present between the two third electrodes. After ignition the load of each of the piezotransformers is increased. As a result the transformation ratio is decreased and a much lower voltage, the operation voltage, is present between the third electrodes. It is often possible to choose the frequency of the input voltage so that a high enough ignition voltage as well as, after ignition, a proper operation voltage results.

Figure 2A:
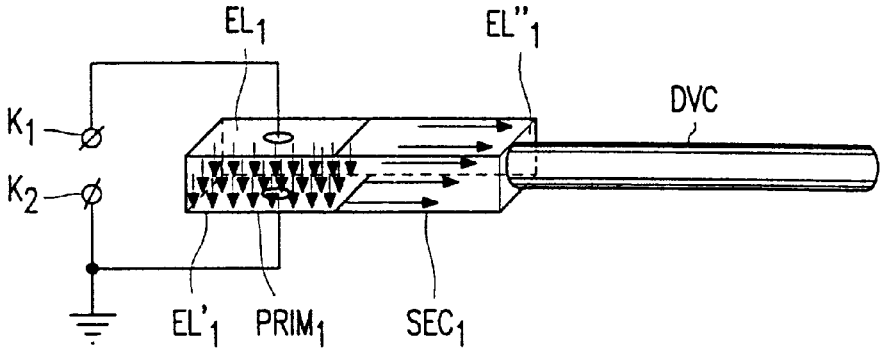
Figure 2B:
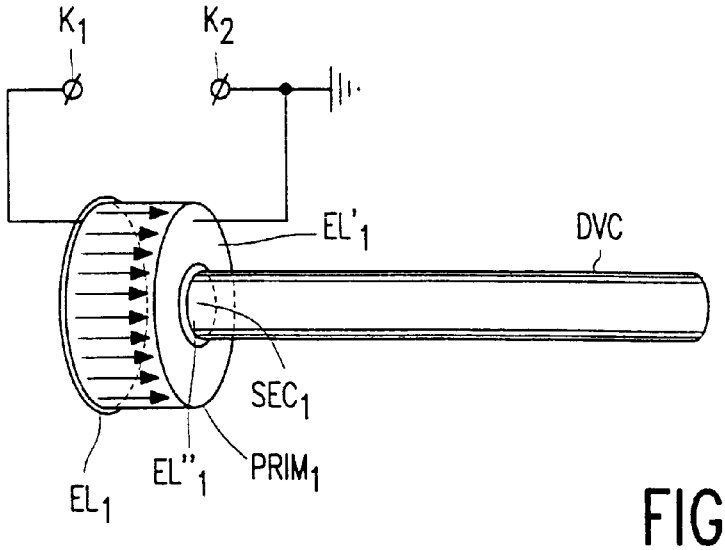

In FIG. 2*a* and 2*b* lamp parts that are similar to lamp parts comprised in the embodiment shown in FIG. 1 have been labelled correspondingly. The embodiment shown in FIG. 2*a* comprises only one piezotransformer of which the secondary side SEC1 is sealed in a vacuum tight way to one end of a cylindrical glass discharge vessel DCV. The other end of the cylindrical discharge vessel is closed. The piezotransformer is of the Rosen type and has the shape of a square parallelepiped. The primary side PRIM1 and the secondary side SEC1 are polarized as in piezotransformer PT1 in FIG. 1. Electrodes E11 and E11' are placed in the same way as in piezotransformer PT1 in FIG. 1. The outer surface of the secondary side SEC1 that is in contact with the discharge vessel DCV functions as a third electrode E11" of the piezotransformer. Electrodes E11 and E11' are connected to input terminals K1 and K2. During operation K2 is kept at ground potential.

The operation of the embodiment shown in FIG. 2*a* is as follows.

When input terminals K1 and K2 are connected to a source of an input voltage with a frequency that is close to one of the resonance frequencies of the piezotransformer, an output voltage is generated by the piezotransformer that is present between the third electrode E11" and each of the electrodes E11 and E11'. Since the potential of electrodes E11' is ground potential, there is also a relatively high voltage present between the third electrode and ground potential. The glass wall of the discharge vessel functions as a dielectric material that couples the inside of the discharge vessel capacitively with its outside and its surroundings that are at ground potential. In other words the wall of the discharge vessel functions as a second electrode. The discharge lamp is successively ignited and operated by means of the voltage present between the third electrode E11" and ground potential.

The embodiment shown in FIG. 2*b* is very similar to that in FIG. 2*a*. A difference is that the piezotransformer has the shape of a first cylinder with a first radius. The secondary side SEC1 of the piezotransformer has the shape of a second cylinder that has the same axis as said first cylinder but a second radius smaller than the first radius. The part of the first cylinder that is at a distance from the axis greater than the second radius forms the primary side PRIM1 of the piezotransformer. Two opposing surfaces of the primary side are equipped with electrodes E11 and E11' consisting of a metallic layer and connected to terminals K1 and K2. During operation K2 is kept at ground potential. The outer surface of the secondary side SEC1 that is in contact with the discharge vessel DCV functions as a third electrode E11". The primary side PRIM1 is polarized parallel to the axis. The secondary side SEC1 is also polarized parallel to the axis. The discharge vessel DCV is attached to the piezotransformer along the borderline between the primary and secondary side in the surface of the piezotransformer. It has been found that for a proper dimensioning of the piezotransformer the operation frequency can be chosen so that a node of the mechanical vibration of the piezotransformer is present at this borderline. When the attachment of the discharge vessel is along a node, the risk of damage to the attachment by the mechanical vibration is relatively small.

The operation of the embodiment shown in FIG. 2*b* is similar to the operation of the embodiment shown in FIG. 2*a* and will not be discussed separately.

Figure 3:
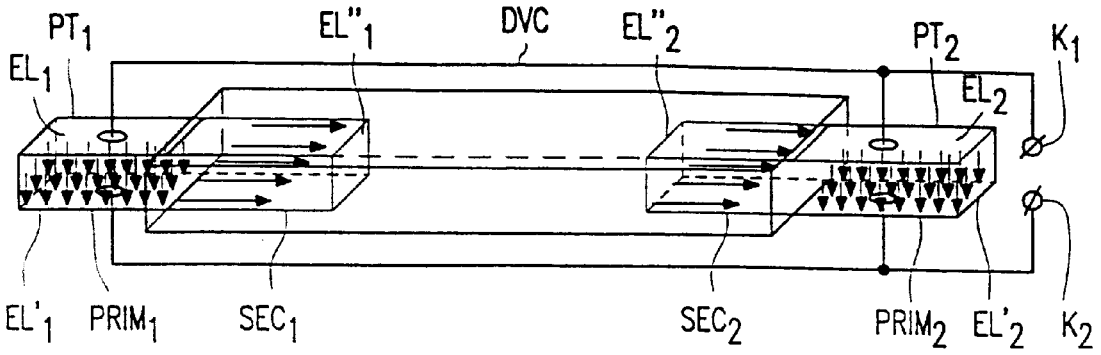

The embodiment shown in FIG. 3 is very similar to the embodiment shown in FIG. 1. The difference is that the discharge vessel DCV is not cylindrical but is formed as a square parallelepiped. Each part of the outer surface of the secondary sides of the piezotransformers that is not in contact with a primary side is surrounded by the discharge vessel. A user of such a discharge lamp can not inadvertently touch the secondary side of a piezotransformer and thereby be exposed to relatively high voltages. In each of the piezotransformers the primary side and the secondary side both are square parallelepipeds of identical dimensions. The discharge vessel is only in contact with a relatively small part of the surface area of the piezotransformer. As in the embodiment shown in FIG. 2*b,* it is preferred to attach the discharge vessel to the piezotransformer along a part of the surface where during operation a node of the mechanical vibration of the piezotransformer is present. In the embodiment in FIG. 3 this is the case along the lines at the surface of the piezotransformer that are in the border plane between the primary and the secondary side, when the piezotransformer is operated in the $\lambda/2$-mode. As is the case in the embodiment of FIG. 2*b,* when the attachment of the discharge vessel is along a node, the risk of damage to the attachment by the mechanical vibration is relatively small.

The operation of the embodiment shown in FIG. 3 is identical to the operation of the embodiment shown in FIG. 1.

Figure 4A:
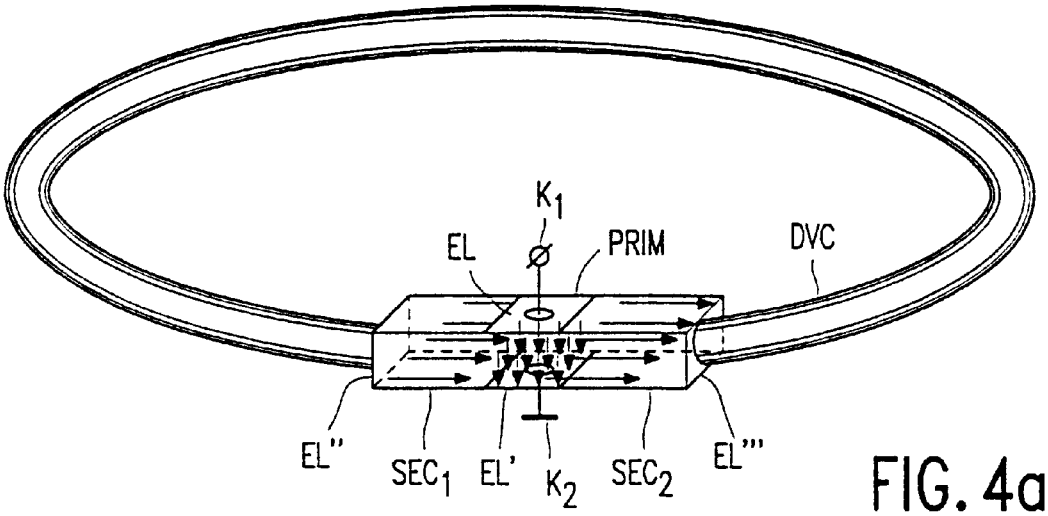
Figure 4B:
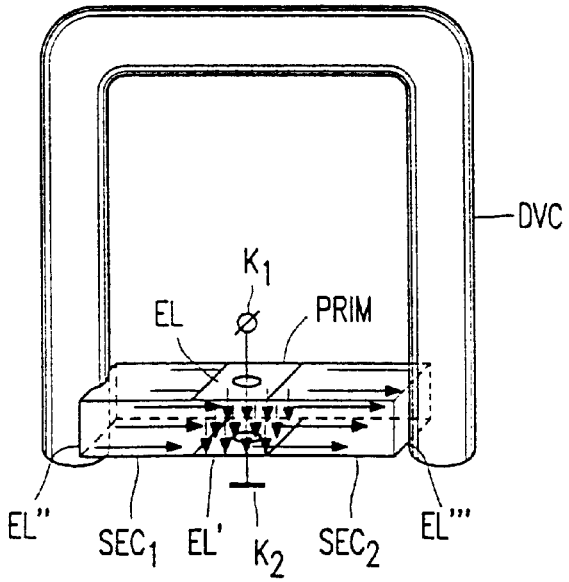

The embodiments shown in FIG. 4*a* and FIG. 4*b* each comprise only one piezotransformer. The piezotransformer is equipped with one primary side PRIM and two secondary sides SEC1 and SEC2. A first end of the discharge vessel DCV is sealed in a vacuum tight manner to secondary side SEC1 of the piezotransformer and a second end of the discharge vessel DCV is sealed in a vacuum tight manner to secondary side SEC2 of the piezotransformer. The piezotransformer is of the Rosen type and is shaped as a square parallelepiped. Two opposing surface areas of the primary side PRIM are covered with electrodes E1 and E1'. The electrodes consist of a metallic layer. The primary side PRIM is polarized in a direction perpendicular to the electrodes E1 and E1'. The secondary sides SEC1 and SEC2 are both polarized in the same direction perpendicular to the direction of polarization of the primary sides and perpendicular to the outer surfaces of the secondary sides SEC1 and SEC2 that are in contact with the discharge vessel DCV and that function as third electrodes E1" and E1'" of the piezotransformer. Electrode E1 and electrode E1' are connected to input terminal K1 and to input terminal K2 respectively. In order to be able to be in contact with both secondary sides of one transformer, the discharge vessel of the embodiment shown in FIG. 4*a* has a round shape and that of the embodiment in FIG. 4*b* a U-shape.

The embodiments shown in FIG. 4 operate as follows.

When input terminals K1 and K2 are connected to a source of an input voltage with a frequency that is close to one of the resonance frequencies of the piezotransformer, it transforms the input voltage to an output voltages with the same frequency but a much higher amplitude that is present between the third electrodes E1" and E1'". If the discharge lamp was not yet ignited, it ignites under the influence of the voltage present between the two third electrodes. After ignition the load of the piezotransformers is increased which decreases its transformation ratio so that a much lower voltage, the operation voltage, is present between the third electrodes after ignition.

Figure 5:
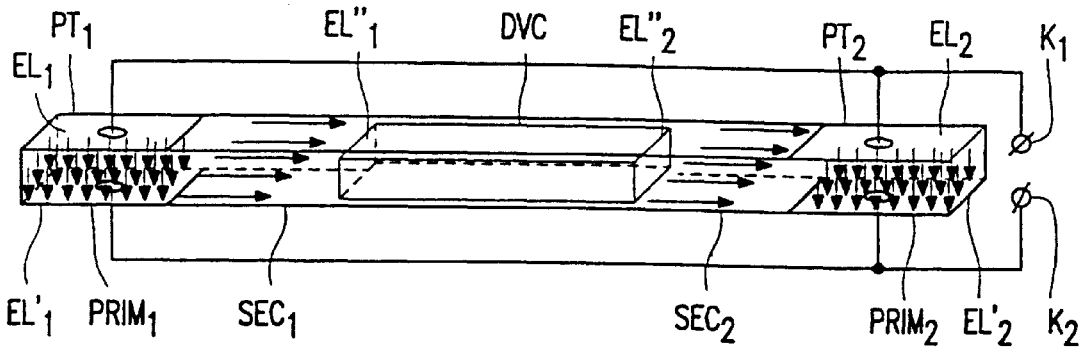

The embodiment shown in FIG. 5 is very similar to the embodiment in FIG. 1. A first difference is that the discharge vessel DCV is formed out of the same material as the piezo transformers. Materials that can be used are for instance Lanthan-doped Lead Zirconate Titanate, Lithium Niobate and Lithium Tantalate. A second difference is that the discharge vessel DCV is not cylindrical in shape but has the shape of a square parallelepiped having the same width and height as both the piezotransformers so that the discharge lamp as a whole also has the shape of a square parallelepiped.

The operation of the embodiment shown in FIG. 5 is identical to that of the embodiment shown in FIG. 1.

In a practical realization of an embodiment of a discharge lamp according to the invention shown in FIG. 1, the discharge vessel consisted of a cylindrical glass tube with an inner diameter of 7 mm and a length of 200 mm filled with argon at a pressure of 5 Torr. The piezoelectric transformers were formed by blocks prepoled piezo-electric ceramic material. This piezo-electric ceramic material consisted of Lead-Zirconate-Titanate (Philips PXE 43). The blocks had a length of 24 mm, a height of 9 mm and a width of 9 mm. The primary sides were equipped with electrodes in the form of conducting metal layers with a length of 12 mm and a width of 9 mm. When the electrodes were connected to a source of AC voltage having an amplitude of approximately 200 Volts and a frequency of 70 kHz, the discharge lamp ignited and a stationary discharge was maintained. The power consumed by the discharge lamp was approximately 8 Watt.

What is claimed is:

1. Discharge lamp comprising a gastight discharge vessel containing a filling which generates electromagnetic radiation during operation, said vessel being transmissive for at least part of said electromagnetic radiation, a piezotransformer comprising a primary side and a secondary side, and a pair of electrodes which maintain a discharge therebetween during operation, at least one of said electrodes forming said secondary side of said transformer.

2. Discharge lamp according to claim 1, wherein the gastight discharge vessel contains a filling that comprises a noble gas and is transmissive for visible light.

3. Discharge lamp according to claim 1, wherein a sheet of conductive material is present between the secondary side of the piezotransformer and the filling of the discharge vessel and covers at least part of the surface area of the secondary side that is inside of the discharge lamp.

4. Discharge lamp according to claim 1, wherein a layer of emitter material is present between the secondary side of the piezotransformer and the filling of the discharge vessel and covers at least part of the surface area of the secondary side that is inside of the discharge lamp.

5. Discharge lamp according to claim 1, wherein the secondary side of the piezotransformer and the filling of the discharge vessel are in direct contact with each other over the total surface area of the secondary side that is inside of the discharge lamp.

6. Discharge lamp according claim 1, wherein the piezotransformer comprises one primary side and two secondary sides and wherein each of the secondary sides is comprised in a different lamp electrode of the discharge lamp.

7. Discharge lamp according claim 1, wherein each lamp electrode of the discharge lamp comprises a piezotransformer and each of the piezotransformers comprises a separate primary side and a separate secondary side.

8. Discharge lamp according to claim 1, wherein the discharge vessel during operation forms a capacitive coupling between the discharge and mass potential, said capacitive coupling functioning as a second lamp electrode.

9. Discharge lamp according to claim 1, wherein the lamp vessel and the piezotransformer consist of the same material.

10. Discharge lamp according to claim 1, wherein the piezotransformer is of the Rosen type.

11. Discharge lamp according to claim 1, wherein the discharge lamp is a low pressure gas discharge lamp.

12. Discharge lamp according to claim 1, wherein the discharge lamp is a low pressure mercury discharge lamp.

13. Discharge lamp according to claim 1, wherein each part of the outer surface of the secondary side of a piezotransformer comprised in an electrode that is not in contact with a primary side is surrounded by the lamp vessel.

14. Discharge lamp according to claim 1, wherein the discharge vessel DCV is attached to the piezotransformer along the borderline between the primary and secondary side in the surface of the piezotransformer.

15. Lighting arrangement comprising a discharge lamp according to claim 1, and a ballast circuit for operating the discharge lamp.

16. Lighting arrangement according to claim 15, wherein the discharge vessel is attached to the piezotransformer at a place where a node of the mechanical vibration is present during operation.

* * * * *